United States Patent [19]

Craemer et al.

[11] 4,240,856

[45] Dec. 23, 1980

[54] CONTINUOUS RUNNING CORRUGATOR

[75] Inventors: Robert H. Craemer; Donald J. Evans, both of Cherry Hill, N.J.

[73] Assignee: Molins Machine Company, Inc., Cherry Hill, N.J.

[21] Appl. No.: 903,350

[22] Filed: May 5, 1978

[51] Int. Cl.[2] ..... B31F 1/20; B65G 37/00; B65G 43/10

[52] U.S. Cl. ..... 156/205; 156/207; 156/269; 156/353; 198/575; 198/577; 198/579; 198/792; 198/859; 226/111; 226/178; 271/69; 271/203; 271/314

[58] Field of Search ..... 156/205, 207, 269, 353; 198/575, 577, 579, 792, 859; 226/111, 178; 271/69, 80, 203

[56] References Cited

U.S. PATENT DOCUMENTS

| | | | |
|---|---|---|---|
| 2,309,728 | 2/1943 | Goettsch | 156/269 |
| 2,764,217 | 9/1956 | Goettsch | 156/367 |
| 2,950,658 | 8/1960 | Moser et al. | 93/58 |
| 2,985,223 | 5/1961 | Thorn . | |
| 3,332,819 | 7/1967 | Siempelkamp | 271/69 X |
| 3,552,744 | 1/1971 | Wertz et al. | 271/80 |
| 3,658,322 | 4/1972 | Martin | 271/76 |
| 3,724,840 | 4/1973 | Kuckhermann | 271/46 |
| 3,831,502 | 8/1974 | Tokuno | 93/1 G |
| 4,018,326 | 4/1977 | Hardy | 198/577 X |

*Primary Examiner*—John T. Goolkasian
*Assistant Examiner*—Robert A. Dawson
*Attorney, Agent, or Firm*—Seidel, Gonda, Goldhammer & Panitch

[57] ABSTRACT

A paperboard web is severed transversely between the double facer machine and the slitter-scorer after the completion of a production order. The speed of the double facer machine is maintained constant while the severed web section is accelerated to a speed substantially above the speed of the double facer machine to create a gap. Adjustments to one or more of the slitter-scorer and cut-off for the next production order are made while the same are in the gap. Sheets cut from the web section are shingled on a shingling conveyor. The speed of the shingling conveyor is accelerated prior to the arrival of the last sheet of the web section and decelerated while the gap is on the shingling conveyor.

9 Claims, 4 Drawing Figures

CONTINUOUS RUNNING CORRUGATOR

BACKGROUND

The relevant portions of a corrugator as pertains to the present invention are the double facer machine, a shear knife, a slitter-scorer, a cut-off, a conveyor downstream from the cut-off, a sheet stacker, in that order and drive means for each unit. Upon completion of one production order, it is conventional to sever the web and create a large gap to thereby facilitate adjustments of the slitter-scorer and/or cut-off. The gap is conventionally attained by substantially decreasing the speed of the double facer machine while the web section is processed at the previous speed of the double facer machine. For relevant prior art in that regard, see U.S. Pat. Nos. 2,309,728; 2,764,217; 2,950,658 and 2,985,223.

During any given day, the production order changeover may occur as often as 6 to 7 times. The repetitive acceleration and deceleration of the speed of the double facer machine over a wide speed range with its attendant corresponding changes on the apparatus for controlling transfer of heat to the web is considered to be undesirable from a quality standpoint. More uniform quality is attained if the double facer machine speed remains at a constant.

Since the rate of production of paperboard depends on the speed of the double facer machine, it will be appreciated that substantial decreases in the speed of the double facer constitute a decrease in production. There is an ever-increasing desire to minimize operations which have an undesired effect on production. Another complicating factor not considered by the prior art described in said patents is the present desire to create and maintain a gap in the shingled sheets on conveyors downstream from the cut-off to separate one production order from the next order.

The continuously running corrugator coupled to an automatic sheet stacker does not provide sufficient time on the conveyors to separate the sheets of one order and the different sized sheets of a following order. Not only must there be a gap between the sheets of the two orders but it must be long enough to provide time for the sheet stacker to prepare itself for the new order. A particular problem arises if the corrugator is processing long sheets which could be 20 feet long. When these sheets are ejected onto the slower moving shingling conveyor, a long gap is required to prevent overlapping of the sheets of the two orders and to allow time for the stacker to cycle.

Prior devices try to grab and hold the first sheet of a new production order while the first sheet is on a shingling conveyor. The object of such devices is to prevent not more than three sheets of one production order from being mixed with another production order. That concept of tolerating a small amount of intermixing of production orders is inoperable when the change of the size of the sheets between orders is small or when the change is from a small sheet of 2to 4 feet to a large sheet of 12 to 20 feet.

The problem solved by this invention is how to create a gap to allow time for set up of machines for a new production run and to maintain a separation between production orders while minimizing changes which have an undesirable effect on production or quality.

SUMMARY OF THE INVENTION

The present invention is directed to a method of creating a gap in a paperboard web produced by a double facer machine. When it is desired to effect an order change, the web is severed transversely thereby producing a web section. Immediately thereafter, the speed of the web section is increased substantially above the speed of the double facer machine to thereby produce a gap. The double facer machine continues to produce the web at the same or substantially the same speed of operation which existed immediately prior to the severing of the web.

The slitter-scorer and cut-off are downstream from the double facer machine and one or both are adjusted for the next production order while they are temporarily disposed within the gap. The sheets cut from the web section are deposited on a shingling conveyor at a first speed. A gap is created on the shingling conveyor between the last sheet of the web section and the first sheet cut from the web for the next production order by increasing the speed of the shingling conveyor to a second substantially higher speed prior to the last sheet of the web section being deposited on the shingling conveyor. When the first sheet of the new production order is deposited on the shingling conveyor, the speed of the shingling conveyor is decreased from said second speed to said first speed thereby maintaining a gap on the shingling conveyor between the sheets of the old production order and the next production order. The shingle ratio at said second conveyor speed is less than 2 to 1.

It is an object of the present invention to provide a reliable method of creating a gap between sheets of two production orders on a shingling conveyor.

It is a further object of the present invention to provide a novel method of creating a gap in a paperboard web which minimizes one operating characteristic which has a tendency to affect quality while at the same time assuring that a gap will be maintained between shingled sheets of one production order and shingled sheets of the next production order.

Other objects will appear hereinafter.

For the purpose of illustrating the invention, there is shown in the drawings a form which is presently preferred; it being understood, however, that the invention is not limited to the precise arrangements and instrumentalities shown.

Referring to the drawings in detail, wherein like numerals indicate like elements, FIG. 1 diagrammatically illustrates the downstream end of a corrugator designated generally as 10.

Figure 1:
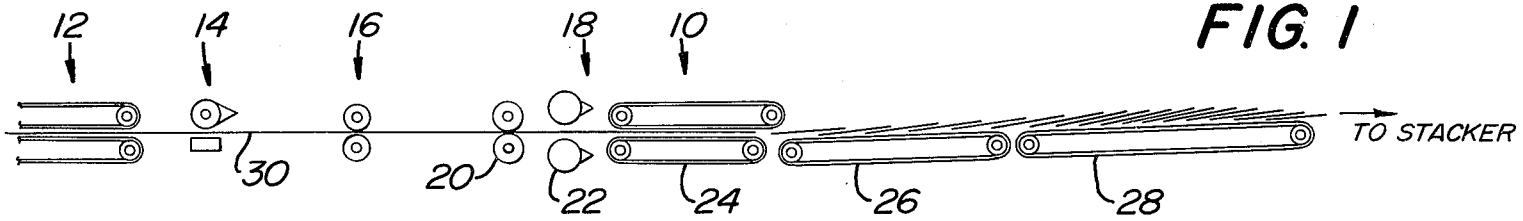
FIG. 1 is a diagrammatic side elevation view of the components of the downstream end of a corrugator beginning with the discharge end of a double facer machine.

The downstream end of the corrugator includes a double facer machine 12, a knife such as a rotary shear 14, a slitter-scorer 16, and a cut-off 18. The cut-off 18 includes feed rolls 20, knife rolls 22, and a sandwich conveyor 24. Downstream from the cut-off 18, there is provided conveyor means for shingling the sheets such as first shingling conveyor 26 and second shingling conveyor 28 in line with the web 30 being processed.

The sheets shingled on the conveyor 28 are discharged into an automatic stacker not shown.

Figure 2:
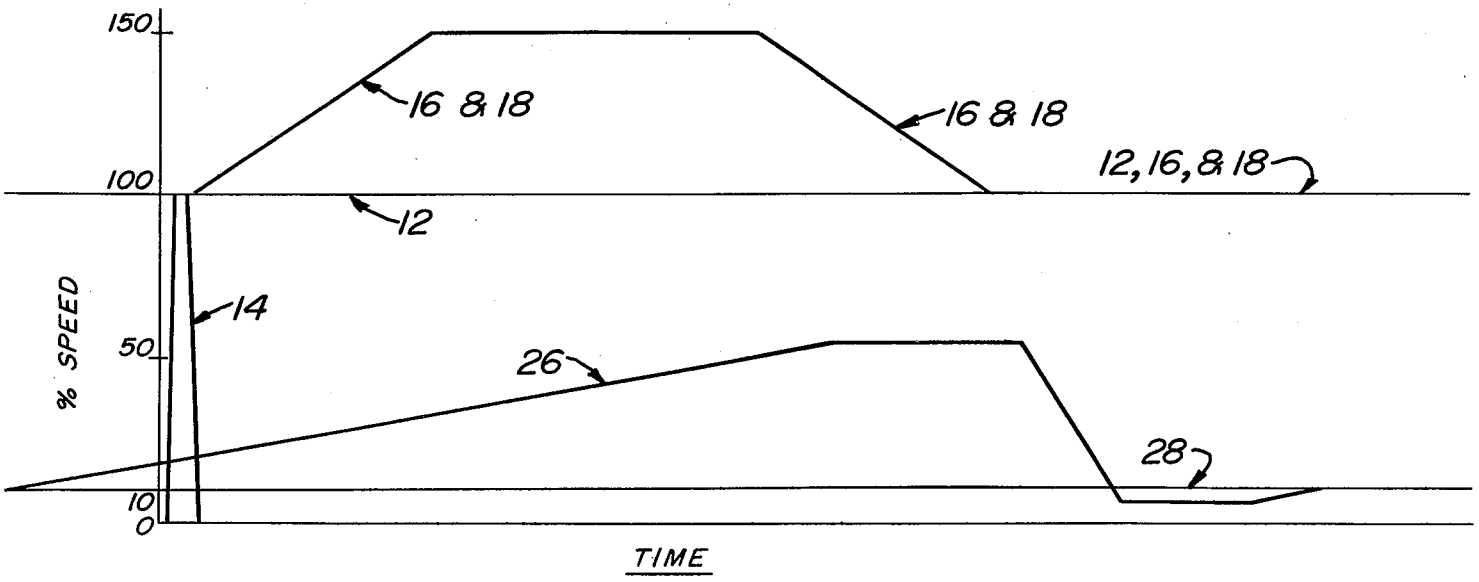
FIG. 2 is a line graph of percent of speed versus time.

FIG. 2 illustrates a graph of percent of speed versus time in a preferred embodiment wherein various components of the corrugator are provided with individual DC electrical drive motors. The various components of the graph in FIG. 2 are labeled with numerals corresponding to the machines illustrated in FIG. 1 and described above. In this manner, the speed of the components is more easily correlated. As shown in FIG. 2, the speed of the double facer machine 12 and the speed of the shingling conveyor 28 remain constant at a preselected operating speed.

When one production run is completed and it is desired to commence a new production run, a gap is created in the web 30 in the following manner. The web 30 is severed transversely by a shear knife preferably part of a rotary shear 14. As illustrated in FIG. 2, the speed of the rotary shear 14 increases from zero up to the speed of the double facer machine, then the web is severed, and then the speed of the rotary shear 14 decreases to zero. Substantially simultaneously with the severing of the web 30, the speed of the slitter-scorer 16 and the cut-off 18 are increased in a gradual manner to a level such as 150% of the speed of the double facer machine 12. The speed to which the slitter-scorer 16 and cut-off 18 are accelerated is a function of the linear distance from the discharge end of the double facer machine to the cut-off 18, the length of sheet being cut and consequently the length of the gap desired in the web 30. On a particular corrugator, the increase of speed of the slitter-scorer 16 and cut-off 18 to 150% of the speed of double facer machine 12 will produce a 20 foot gap in the web 30.

The portion of the web downstream from the rotary shear 14 at the time the web 30 is severed will be referred to hereinafter as the web section. The web section is processed in a normal manner by the slitter-scorer 16 and cut-off 18 at the increased speed for a predetermined length of time so as to create the 20 foot gap. Thereafter, the speed of the slitter-scorer 16 will decrease back to the speed of the double facer machine 12. Also, the speed of the cut-off 18 will decrease back to the speed of the double facer machine 12. While the slitter-scorer 16 and/or cut-off 18 are in the gap, any desired adjustments of the components thereof for the next production order are made. A wide variety of systems for automatically programming and attaining the adjustment of a slitter-scorer and/or cut-off for a new production order within seconds are known to those skilled in the art.

A signal to sever web 30 or a signal prior in time such as a signal from the production counter is used to cause the shingling conveyor 26 to accelerate gradually. The shingling conveyor 26 accelerates from about 10% of the speed of the double facer machine 12 to a maximum of about 55% of the speed of double facer machine 12 so that (a) at least some of said 20 foot gap will exist at conveyor 26 regardless of the sheet lengths involved, and (b) the sheets on the conveyor 26 will have a shingling ration of less than 2 to 1. The maximum speed ratio of 55% corresponds to a 20 foot sheet. Thereafter, the speed of the shingling conveyor 26 remains constant for a short period of time sufficient to enable the first sheet of the next production order to be deposited thereon. When this occurs, the shingling conveyor 26 immediately decelerates back to the speed of the shingling conveyor 28.

It is necessary to maintain a gap on the shingling conveyor 26 and/or 28 between the last sheets of one production order and the first sheets of a new production order since the respective sheets will be of different sizes and/or will be slotted differently. If necessary, the size of the gap on the shingling conveyor 26 may be adjusted within limits by reducing the speed of the shingling conveyor 26 to a speed below that of the shingling conveyor 28 for a short period of time as shown in FIG. 2.

The present operating speeds of a corrugator require the shingling conveyor 26 to be able to accelerate and decelerate over a wide range of speeds from about 40 feet per minute to about 350 feet per minute, respectively. Hence, conveyor 26 has a minimum length of at least the maximum sheet length capable of being handled plus the distance that the sheet will travel during deceleration or acceleration. Assuming a maximum speed of 350 feet per minute and a minimum speed of 40 feet per minute for the shingling conveyor 26, and assuming a coefficient of friction between the paperboard and the conveyor belt of 0.15, calculations using conventional formulas result in the deceleration or acceleration distance being 3.5 feet with time being one second. Thus, the minimum length for conveyor 26 is 3.5 feet plus the maximum sheet length capable of being handled. The maximum sheet length capable of being handled is determined by the cut-off 18 and is a known factor in any corrugator. In a typical corrugator, sheet length can be as small as 2 feet or as large as 20 feet.

The coefficient of friction between the paperboard sheets and the belts of the shingling conveyor is a known factor. In the above description, it was assumed that the coefficient of friction was 0.15. Assuming a coefficient of friction of 0.10, a deceleration or acceleration distance increases to 5.25 feet. Hence, as the coefficient of friction between the sheets and the shingling conveyor decreases, the minimal length of the shingling conveyor increases.

The graph in FIG. 2 assumes that the various machines are provided with individual DC drive motors. From the standpoint of timing the arrival of the new order, the range of friction coefficients and limiting torque requirements, it is preferred that the deceleration time be established at not less than 2 seconds. Hence, when the coefficient of friction is 0.15, the preferred minimum length of shingling conveyor 26 in connection with the embodiment of FIG. 2 is the length of the maximum sheet capable of being handled plus 7½ feet. In other words, the above calculated 3½ foot length has been increased to 7½ feet in order to avoid problems with torque, timing, etc.

Figure 3:
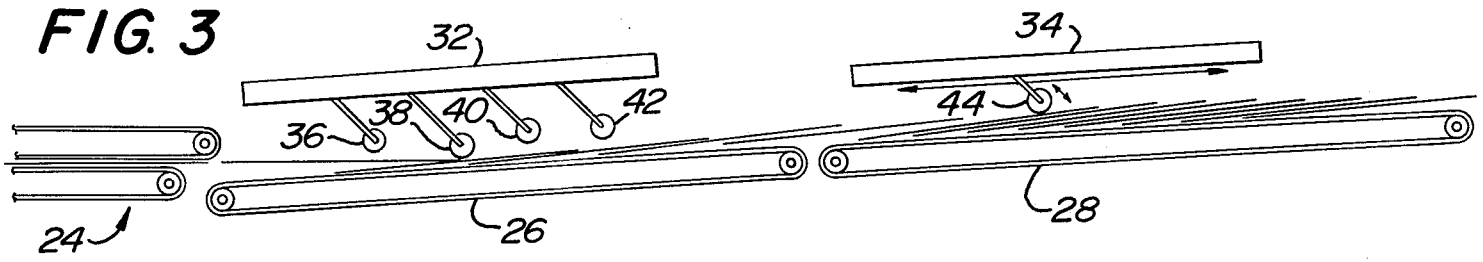
FIG. 3 is a diagrammatic side elevation view of the first and second sections of a shingling conveyor.
Figure 4:
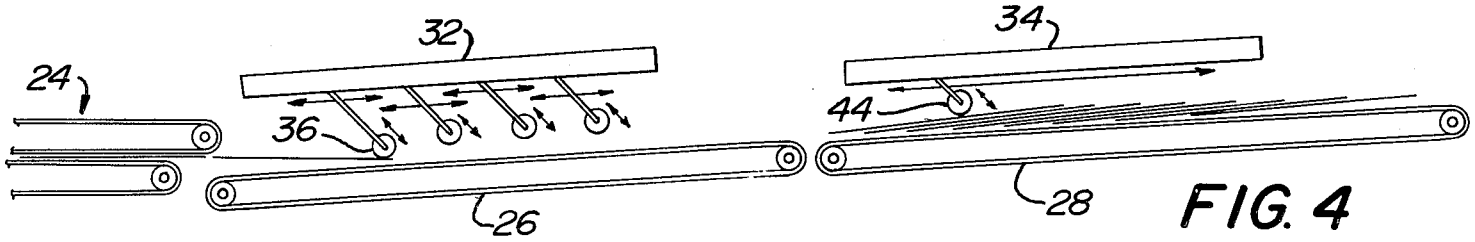
FIG. 4 is a view similar to FIG. 3.

In order to preserve the shingle on the conveyors 26 and 28, during the deceleration and acceleration of shingling conveyor 26, it is desirable to provide a snub control. In FIG. 3, there is shown a snub control in the disposition wherein the last sheet of the web section is being deposited on the shingling conveyor 26. In FIG. 4, there is shown the position of the snub control when the first sheet of the next production order is being deposited on the shingling conveyor 26. Note that the first sheet arriving at conveyor 26 in FIG. 4 is shorter than the sheets being shingled in FIG. 3.

Referring to FIG. 3, shingling conveyor 26 is provided with a snub control designated generally as 32 and conveyor 28 is provided with a snub control designated generally as 34. The snub controls may include spring loaded fingers or snub rolls. For the purposes of this disclosure, the snub controls 32, 34 are provided with rolls. Thus, snub control 32 has a plurality of rolls 36, 38 40 and 42 at spaced points therealong. Each of the rolls 36, 48, 40 and 42 is supported for vertical movement and for translation along the length of the snub control 32 parallel to conveyor 26. Snub control 34 is provided with a single roll 44 which is supported for similar movement.

The snub roll 44 should be in the position shown in FIG. 3 for contact with the last few sheets of the web section when the shingling conveyor 26 is accelerating. By the time the first sheet of the new production order reaches the shingling conveyor 26 as shown in FIG. 4, the snub rolls 36, 38, 40, 42 and 44 will assume the position shown in FIG. 4. When the first sheet of the new production order reaches the shingling conveyor 26, the speed of shingling conveyor 26 will decelerate to match the speed of shingling conveyor 28. While in the gap, each of the snub rolls can be relocated as to position and elevation for the next order change.

The snub rolls 36, 38, 40, 42 and 44 are particularly desirable when the sheets being processed are short. Short sheets tend to become airborne at high speeds. The rolls hold the sheets down against the belts of their respective conveyors 26, 28. One of the rolls 36, 38, 40 and 42 is adjusted to be in its lowermost or operative position to snub the leading edge of the sheets deposited on conveyor 26. The particular roll to be operative depends on the length of sheet being processed.

Referring to FIG. 4, when the sheet length is outside the range of adjustment for roll 36, roll 36 is elevated and roll 38 descends. When the sheet length exceeds the range of roll 38, roll 38 ascends and roll 40 descends. Only one of rolls 36, 38, 40 and 42 is normally in an operative position. Movement of the snub rolls parallel to their conveyor is attained by a servo motor. The snub rolls are moved up and down in any manner such as by use of solenoids.

In view of the above description, it is believed that no detailed explanation of operation is needed. From the above description, it will be noted that the present invention contemplates maintaining the speed of the double facer constant at the then existing operating speed during the changeover from one production order to another so as not to change the heat balance at the doubler facer machine. There is one exception to maintaining the speed of the double facer constant and that is when a change order is initiated with the double facer operating at maximum speed. In this situation, the double facer speed will drop slightly for a short period of time. For example, if a change order is initiated with the double facer operating at a maximum speed of 600 fpm, its speed could drop to 500 fpm and then return to 600 fpm with the total elapsed time being about 12 seconds.

As mentioned above, acceleration of conveyor 26 is preferably initiated at or prior to severing a web 30. Limit switches which ride on the web or photocells can be used to initiate deceleration of the cut-off 18, slitter-scorer 16 and/or conveyor 26. A microprocessor could be used to control all speed changes and operate the snub controls.

The present invention may be embodied in other specific forms without departing from the spirit or essential attributes thereof and, accordingly, reference should be made to the appended claims, rather than to the foregoing specification as indicating the scope of the invention.

I claim:

1. A method of creating a gap in a paperboard web comprising:

(a) producing a continuous paperboard web at a double facer machine, (b) severing said web transversely when it is desired to effect an order change thereby producing a severed web section, (c) producing a gap between the leading edge of the severed web and the trailing edge of the web section, (d) adjusting one or more of a slitter-scorer and the cut-off for the next production order while the same are in said gap, (e) shingling the sheets cut from said web section on a shingling conveyor operating at a first speed which is substantially below the speed of said double facer machine, (f) maintaining at least some of said gap on said shingling conveyor between the last sheet cut from said web section and the first sheet cut from the web for the next production order by increasing the conveyor speed of the shingling conveyor to a second conveyor speed substantially higher than said first conveyor speed prior to depositing the last sheet of the web section on said shingling conveyor, using a second conveyor speed which results in a shingling ratio less than two to one, and (g) decreasing the speed of said shingling conveyor from said second conveyor speed to said first conveyor speed after the first sheet of the new production run is deposited on the shingling conveyor.

2. A method in accordance with claim 1 including maintaining the speed of the double facer machine constant during steps (b) through (g).

3. A method in accordance with claim 1 or 2 including using individual DC drive motors for the double facer machine, slitter-scorer, cut-off and shingling conveyor.

4. A method in accordance with claim 1 including using a shingling conveyor having a length which is approximately 7.5 feet longer than the maximum length of sheet capable of being handled by the cut-off.

5. A method in accordance with claim 1 including providing a snub control for said shingling conveyor including elements that are adjustable vertically toward and away from the shingling conveyor and movable longitudinally along the shingling conveyor, and using one of said elements to snub the leading edge of sheets deposited on said shingling conveyor.

6. A method in accordance with claim 1 wherein step (c) includes increasing the speed of the cut-off and the slitter-scorer to a speed above the double facer speed, decelerating the speed of the cut-off and the slitter-scorer to match the speed of the double facer machine prior to arrival of the leading edge of the web at each of these for the new production order, and commencing with acceleration of the shingling conveyor from the first conveyor speed to the second conveyor speed prior to increasing the speed of the cut-off.

7. A method in accordance with claim 1 including adjusting the size of a gap on the shingling conveyor between the last sheet of one production order and the first sheet of a new production order by decelerating the shingling conveyor from said second conveyor speed to a third conveyor speed which is below said first conveyor speed and then accelerating the shingling conveyor from the third conveyor speed to said first conveyor speed.

8. A method in accordance with claim 1 wherein said second conveyor speed is not less than 55% of the speed of said double facer machine.

9. A method of creating a gap in a paperboard web comprising:

(a) producing a continuous paperboard web at a double facer while independently driving a slitter-scorer and a cut-off downstream from said double facer, (b) severing said web transversely when it is desired to effect an order change thereby producing a severed web section, (c) increasing the speed of said web section and the cut-off and the slitter-scorer to a speed substantially above the speed of the double facer to produce a gap between the leading edge of the web and the trailing edge of the web section, decreasing the speed of the cut-off and the slitter-scorer to match the speed of the double facer when the desired length of gap has been achieved, (d) adjusting one or more of a slitter-scorer and the cut-off for the next production order while the same are in said gap, (e) shingling the sheets cut from said web section on a shingling conveyor operating at a first conveyor speed which is substantially below the speed of said double facer, (f) maintaining at least some of said gap on said shingling conveyor between the last sheet cut from said web section and the first sheet cut from the web for the next production order by increasing the conveyor speed of the shingling conveyor to a second conveyor speed substantially higher than said first conveyor speed and not less than 55% of double facer speed prior to depositing the last sheet of the web section on said shingling conveyor, (g) decreasing the speed of said shingling conveyor from said second conveyor speed to said first conveyor speed after the first sheet of the new production run is deposited on the shingling conveyor, and (h) maintaining the speed of the double facer constant during steps (b) through (g).

* * * * *